US011273351B2

(12) United States Patent
Stringham et al.

(10) Patent No.: US 11,273,351 B2
(45) Date of Patent: Mar. 15, 2022

(54) INTERACTIVE ELECTRONIC TABLE TENNIS GAME

(71) Applicants: Thomas Stringham, East Bethany, NY (US); Benjamin P Hencke, Vancouver, WA (US)

(72) Inventors: Thomas Stringham, East Bethany, NY (US); Benjamin P Hencke, Vancouver, WA (US)

( * ) Notice: Subject to any disclaimer, the term of this patent is extended or adjusted under 35 U.S.C. 154(b) by 13 days.

(21) Appl. No.: 16/868,024

(22) Filed: May 6, 2020

(65) Prior Publication Data

US 2020/0353334 A1 Nov. 12, 2020

Related U.S. Application Data

(60) Provisional application No. 62/844,407, filed on May 7, 2019.

(51) Int. Cl.
*A63B 67/04* (2006.01)
*A47B 25/00* (2006.01)
*A63B 61/00* (2006.01)

(52) U.S. Cl.
CPC ..... *A63B 67/04* (2013.01); *A47B 25/003* (2013.01); *A63B 61/003* (2013.01); *A63B 2210/50* (2013.01); *A63B 2220/64* (2013.01); *A63B 2220/833* (2013.01); *A63B 2225/74* (2020.08)

(58) Field of Classification Search
CPC ..... A47B 13/08; A47D 11/00; A63B 71/06; A63B 69/40
See application file for complete search history.

(56) References Cited

U.S. PATENT DOCUMENTS 5,020,802 A * 6/1991 af Strom ..... A63B 69/3623 473/156
7,520,827 B1 * 4/2009 Esposito ..... A63B 67/04 473/475
2001/0006915 A1 * 7/2001 Minami ..... A63B 69/406 473/496
2004/0204258 A1 * 10/2004 Hanoun ..... A63B 67/02 473/154
2007/0062852 A1 * 3/2007 Zachut ..... A63F 3/00643 209/683

(Continued)

*Primary Examiner* — Eugene L Kim
*Assistant Examiner* — Christopher Glenn
(74) *Attorney, Agent, or Firm* — Stadler IP Law PLLC

(57) ABSTRACT

An interactive electronic table tennis game is provided that has a table having first and second table portions that are foldable. There are first and second table portions that are structurally the same, and the second table portion has a flat top that is made of a hard material that is clear, transparent, or translucent such that light can pass through the hard material. The flat top is mounted on a frame that defines a plurality of compartments and lights or light emitting diodes that are positioned in the compartments. The frame also supports electronics. The electronics have audio pickups, converter microcontrollers, and a table tennis game computer. When a ball hits the first and second table portions light is emitted by the LEDs in that compartment. This makes the interactive electronic table tennis game fun to play and fun to watch, because everyone can see where the ball impacts.

8 Claims, 5 Drawing Sheets

(56) References Cited

U.S. PATENT DOCUMENTS

| | | | | |
|---|---|---|---|---|
| 2010/0038854 | A1* | 2/2010 | Mraz | F41J 5/056<br>273/371 |
| 2014/0179385 | A1* | 6/2014 | Homsi | A63B 63/00<br>463/7 |
| 2015/0090162 | A1* | 4/2015 | Vlosich | A47D 11/00<br>108/18 |
| 2016/0045800 | A1* | 2/2016 | Traustason | A63B 69/00<br>473/435 |
| 2016/0158626 | A1* | 6/2016 | Dolige | A63B 71/0669<br>700/92 |
| 2016/0183674 | A1* | 6/2016 | Lee | A47B 25/003<br>108/161 |
| 2018/0093160 | A1* | 4/2018 | Alhadeff | A63B 24/0062 |

* cited by examiner

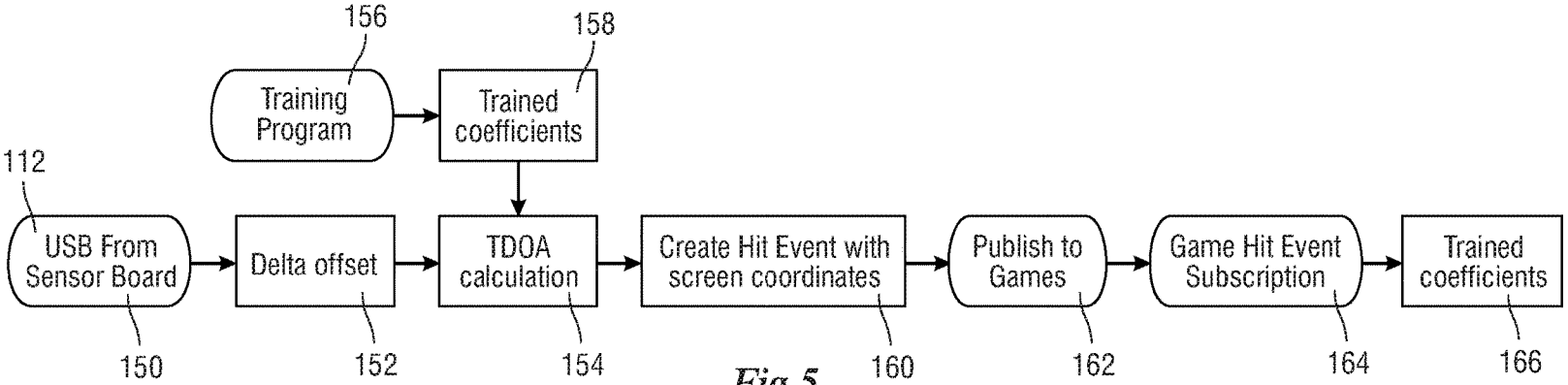
Fig.5
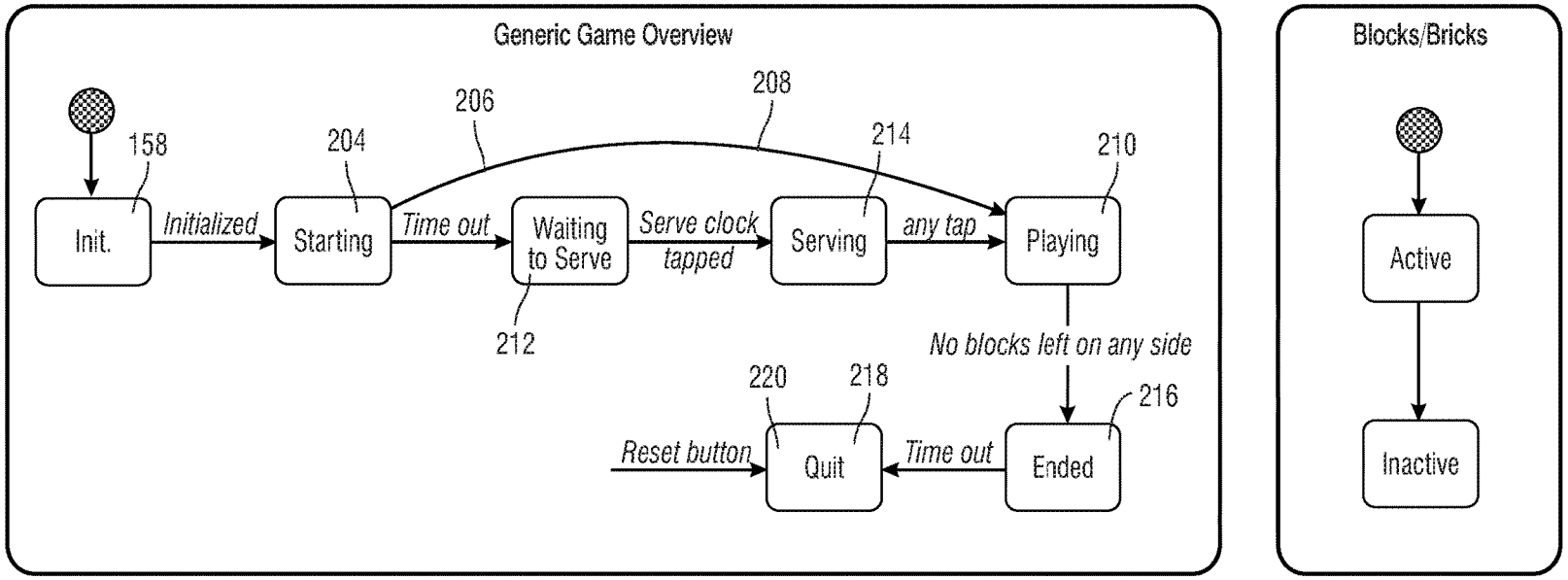
Fig.6
Fig.7

INTERACTIVE ELECTRONIC TABLE TENNIS GAME

CROSS-REFERENCE TO RELATED APPLICATIONS

This application claims priority to U.S. Provisional Application having Ser. No. 62/844,407, filed on May 7, 2019, the entire disclosure of which is hereby incorporated herein by reference.

FIELD OF INVENTION

The present invention relates to a table tennis game. More particularly, to an an interactive electronic table tennis game.

BACKGROUND

Many people call a game that is played with paddles and a lightweight ball on a flat table top having a net by the name PING PONG®. The name PING PONG® was and currently is a Registered United States Trademark that was registered during the 1930s for use in connection with indoor bat or racket games, table games, tennis type games and the like.

From its inception other similar table games have been made and sold (with different names), but the fundamentals of these games have not changed. In other words, all such games have a table, a net, a lightweight ball, and paddles to hit the ball over the net. One could even go so far as to say that other than some modern surface materials applied to the paddles used in tennis table games, such games have failed to keep up with modern times and modern technology.

For these reasons tennis table games are not as popular with many people because such people are looking for new and exiting games to play.

What is needed is a new table tennis game that is extremely fun to play, that is capable of providing immediate feedback to players, that is relatively inexpensive, and that will be interesting enough to cause more people to play the table tennis game and cause more spectators to watch the table tennis games being played.

SUMMARY

As described herein, an interactive electronic table tennis game that has a table and the table has first and second table portions that almost abut one another when the interactive electronic table tennis game is in a horizontal position, and face one another when the interactive electronic table tennis game is folded into a vertical position. In addition, wheels are provided such that when in the vertical position the interactive electronic table tennis game can be pushed and moved to an out of the way location.

The second table portion is structurally the same as the first table portion, and the second table portion has a flat top that is made of a hard material and has a matte finish in one embodiment, and the hard material is made of plastic in one embodiment. In addition, the flat top is clear or transparent in one embodiment, and in other embodiments the flat top allows light to pass through it, and in other embodiments the flat top may be tinted but still allows light to pass through it, or the flat top may be translucent.

The flat top is mounted on a frame that is made of first and second spaced apart strips of material that are perpendicular to one another in one embodiment. In other embodiments the first and second spaced apart strips of material may be at an angle to one another. The first and second spaced apart strips of material are made of plywood, but in other embodiments are made of plastic or other suitable material. In one embodiment the first and second spaced apart strips of material are constructed so they interlock with one another. The frame also includes a frame base that is supported by the first and second spaced apart strips of material. Thus, the frame defines a plurality of compartments and lights or light emitting diodes that are positioned in the compartments.

The frame also supports the electronics. The electronics have audio pickups and converter microcontrollers and a table tennis game computer. When a ball hits the first and second table portions and light is emitted from that compartment. This makes the interactive electronic table tennis game both fun to play and fun to watch because everyone can see where the ball impacts the first and second table portions.

BRIEF DESCRIPTION OF THE DRAWING FIGURES

Figure 2:
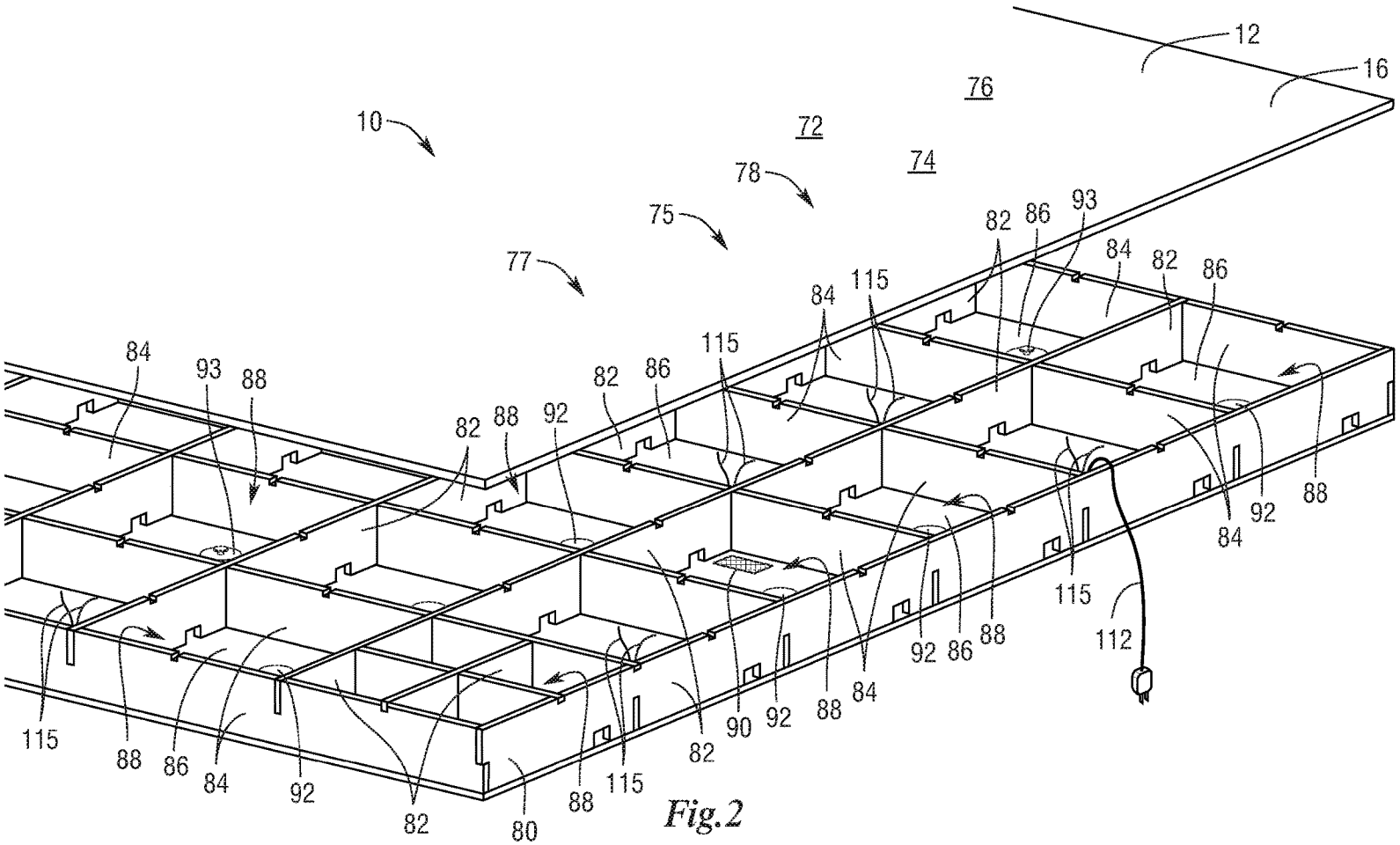
FIG. 2 shows an expanded view of a portion of a table and a support structure of the interactive electronic table tennis game.
Figure 2A:
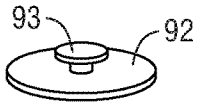

FIG. 2*a* shows a light emitting diode (LED).

Figure 3:
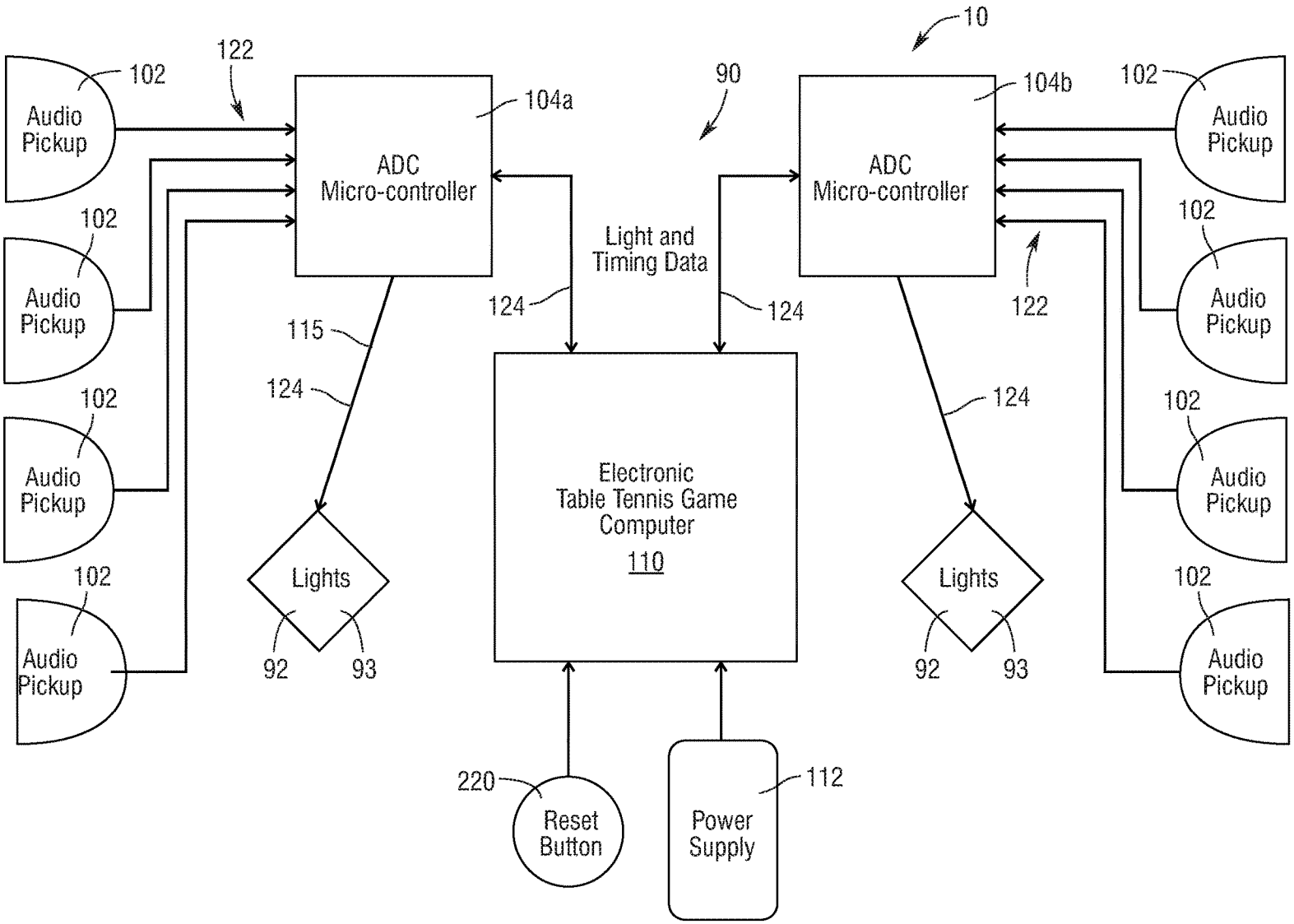

FIG. 3 shows the electronics of the interactive electronic table tennis game.

Figures 4A, 4B:
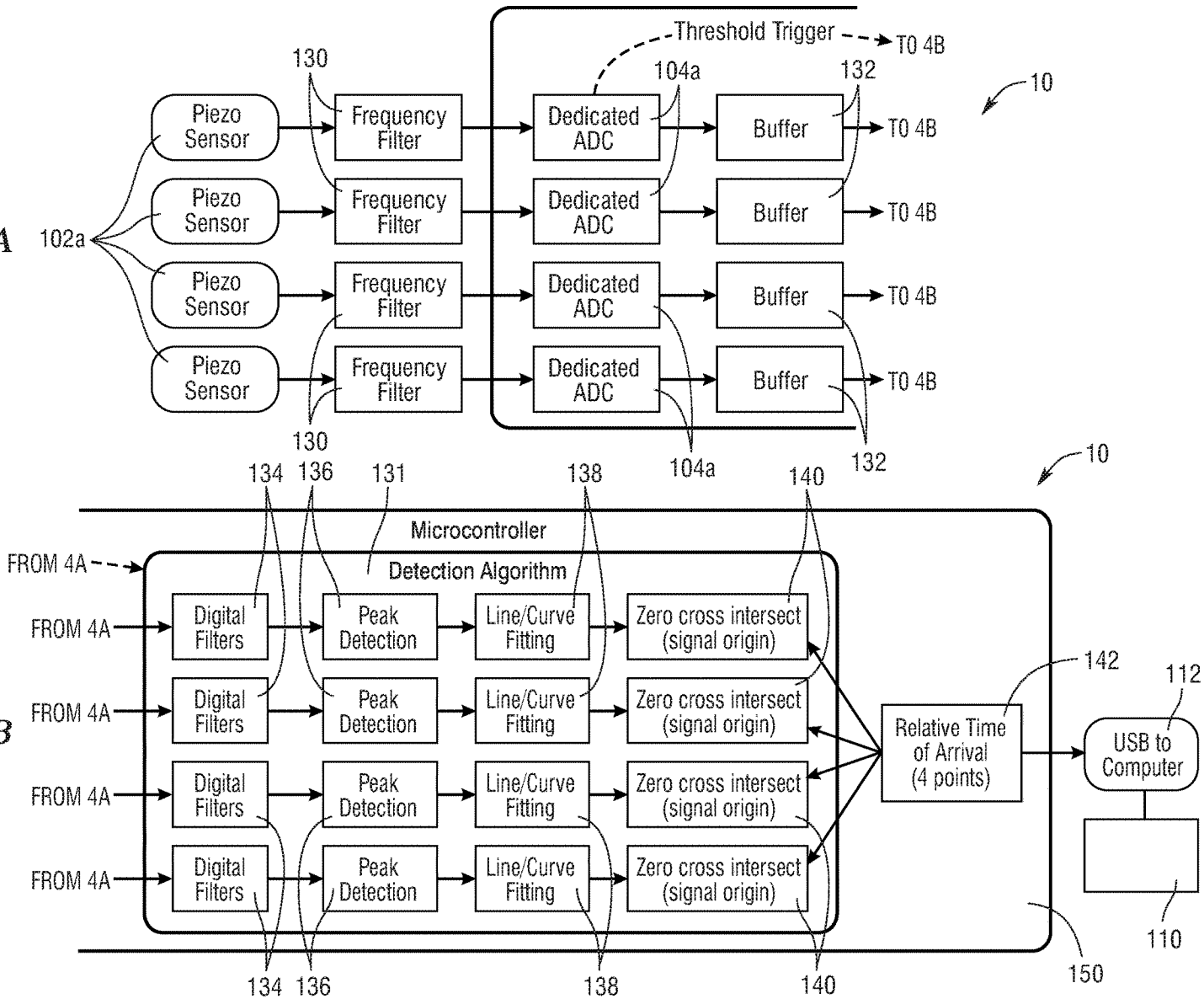

FIG. 4A is a diagrammatic view of the first analog to digital converter micro controllers.

FIG. 4B is a diagrammatic view of the first analog to digital converter micro controllers.

FIG. 5 shows a flowchart depicting a USB from a sensor board.

FIG. 6 shows a flowchart of a generic game overview of the interactive electronic table tennis game.

FIG. 7 shows the compartments or blocks going from an active state to an inactive state.

DETAILED DESCRIPTION OF THE INVENTION

Figure 1:
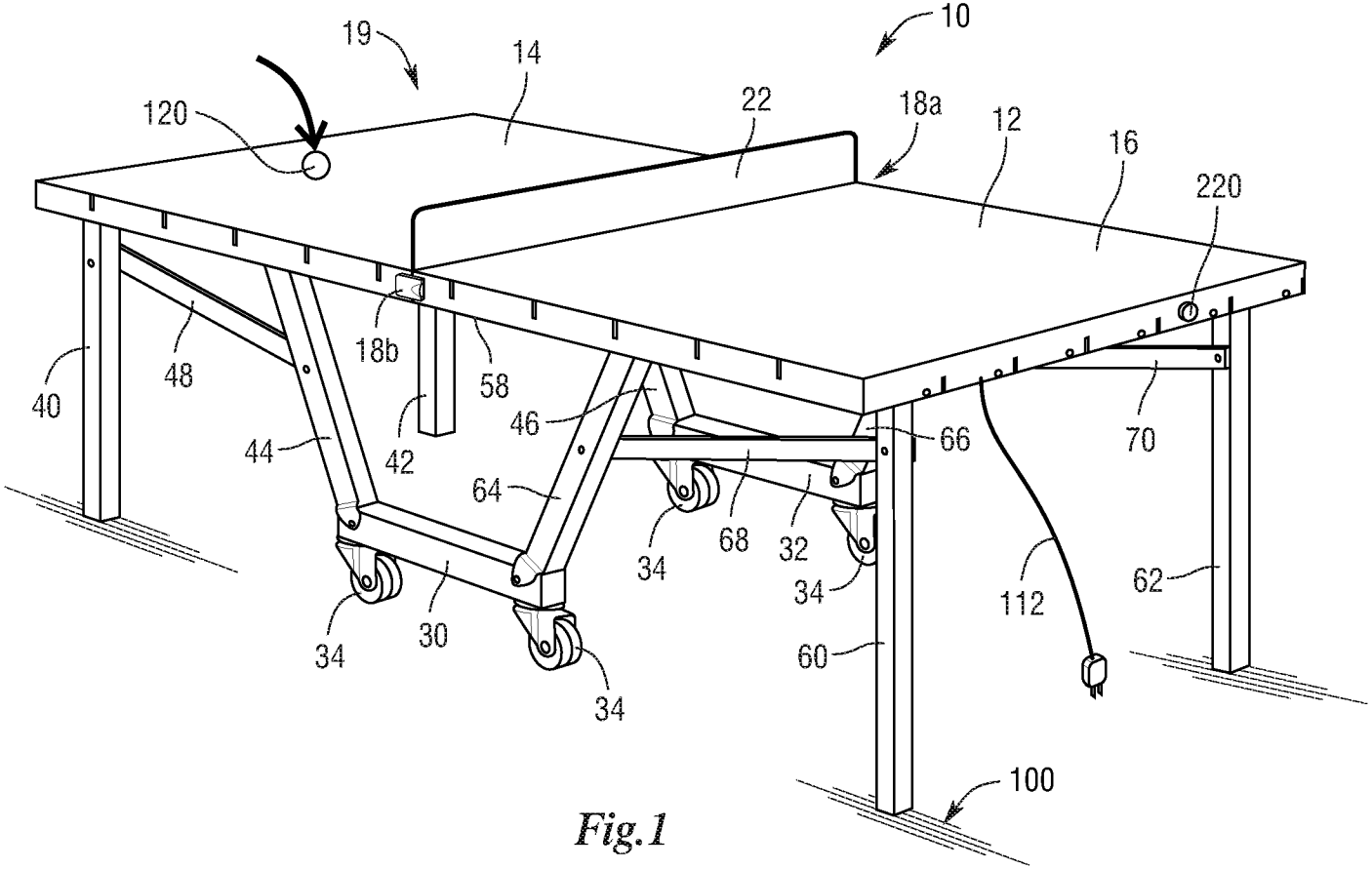
FIG. 1 shows a perspective view of an interactive electronic table tennis game.

As shown in FIG. 1 there is a perspective view of an interactive electronic table tennis game 10 that is supported on the ground or floor 100. The interactive electronic table tennis game 10 has a table 12 and the table has first and second table portions 14, 16, respectively, that abut one another and are secured to one another with diametrically opposed first and second release/secure mechanisms 18*a*, 18*b*, such that the first and second table portions 14, 16, can move relative to one another from vertical position (not shown) to horizontal position 19 shown in FIG. 1 and vice versa. In the vertical position, the table tennis game is folded and may be moved out for storage purposes. The folding of table tennis games is well known in the art and thus will not be described.

One of the first and second table portions 14, 16, supports a dividing net 22 and the dividing net 22 is clear plastic and has a black border in one embodiment. The dividing net 22 may also be made in the form of a mesh in other embodiments.

As shown in FIG. 1, the dividing net 22 extends from the table 12 in a direction away from the ground or floor 100 as shown in FIG. 1.

The first and second table portions 14, 16, are supported on first and second base members 30, 32, and each of the first and second base members 30, 32, are mounted on a pair of wheels or casters commonly designated 34. The wheels 34 permit the interactive electronic table tennis game 10 to be pushed, for example when in a vertical position.

The first table portion 14 of the table 12 is supported on first and second legs 40, 42, second and third angled legs 44, 46, and third and fourth cross arms 48, 58, that can pivot relative to one another such that first table portion 14 can be moved from the horizontal position 19 to the vertical position and vice versa.

Similarly, the second table portion 16 of the table 12 is supported on first and second legs 60, 62, second and third angled legs 64, 66, and third and fourth cross arms 68, 70, that can pivot relative to one another such that second table portion 16 can be moved from the horizontal position 19 to the vertical position and vice versa.

In another embodiment, there is only a single table portion that is a one part piece, and in such an embodiment the table 12 is not foldable because it is a one piece body.

FIG. 2 shows an expanded view of the second table portion 16, it being understood that the first table portion 14 is structurally the same. The second table portion 16 has a flat top 72 that is made of a hard material 74. The hard material 74 has a matte finish 75 in one embodiment, and the hard material 74 is made of plastic 76 in one embodiment. In addition, the flat top 72 is clear or transparent 77 in one embodiment, and in other embodiments light is able to pass through the flat top 72. In other embodiments, flat top 72 may be tinted but still allows light to pass through it, or may be translucent 78.

As shown in FIG. 2, the flat top 72 is mounted on a frame 80 with adhesives, screws or other suitable fasteners, it being understood that the first table portion 14 is structurally the same and is likewise mounted on a frame. The frame 80 is made of twenty (20) first and second spaced apart strips of material 82, 84, that are perpendicular to one another in one embodiment as shown. In other embodiments the first and second spaced apart strips of material 82, may be at an angle to one another. The first and second spaced apart strips of material 82, 84, are made of plywood and in other embodiments are made of plastic or other suitable material.

In one embodiment the first and second spaced apart strips of material 82, 84, are constructed so they interlock with one another. The frame 80 also includes a frame base 86 that is supported by the first and second spaced apart strips of material 82, 84, with fasters or adhesives. Thus, the frame 80 defines a plurality of compartments 88 with each compartment 88 being defined by the frame base 86 and pairs of the first spaced apart strips of material 82 and pairs of the second spaced apart strips of material 84. FIG. 2*a* shows light emitting diodes 93 that are positioned in the compartments 88.

It is pointed out that in another embodiment the first and second spaced apart strips of material 82, 84, and frame base 86 could all be made of plastic and formed by plastic molding processes well known to those having ordinary skill in the art.

FIG. 3 shows that positioned inside of the compartments 88 are game electronics 90 and lights 92 and the lights may be light emitting diodes (LEDs) 93 in one embodiment. The lights and LEDs 92, 93, may have the same color, may be white, may be colored, or may be in patterns or colors without limitation. The electronics 90, that are supported by the frame 80, include audio pickups commonly designated by reference numeral 102. The audio pickups 102 may be embodied as piezo sensors 102*a* (as shown in FIG. 4A) or transducers that sense vibrations that produce sounds. There are first and second analog to digital converter micro controllers 104*a*, 104*b*, that are in communication with the LEDs 93 and in communication with an interactive electronic table tennis game computer 110. There is also a power supply 112 for powering the interactive electronic table tennis game 10 and the components thereof. As shown in FIG. 1, the interactive electronic table tennis game 10 has a wire and plug 112 that can be plugged into a conventional outlet, or may be powered by a rechargeable battery pack (not shown). There are wires commonly designated 115 shown in FIG. 3 that connect to the lights and LEDs 92, 93, and the electronics 90.

When a ball 120 (see FIG. 1) is hit by a player (not shown) and contacts the first or second table portions 14, 16, the microcontrollers 104*a*, 104*b*, filter the sound and the time arrival differences of each sensor. This generates timing data 122 that is sent to the interactive electronic table tennis game computer 110. The interactive electronic table tennis game computer 110 takes this timing data 122 and determines where the ball 120 hits on the first and second table portions 14, 16. Then, the interactive electronic table tennis game computer 110 sends LED light data 124 back to the microcontrollers 104*a*, 104*b*, and then the microcontrollers 104*a*, 104*b*, turn the light 92 or LED 93 in the compartment 88 on or off. There is also a reset button 220 that can be used to start a new game.

As shown in FIG. 4B, there is a diagrammatic view of the first analog to digital converter micro controllers 104*a*. As shown, the piezo sensors 102*a* send signals to frequency filters commonly designated 130. From there, the signals are sent to the first analog to digital converter micro controllers 104*a* and from there to buffers commonly designated 132. Then an algorithm 131 is utilized that has digital filters commonly designated 134 that determines peak detection commonly indicated by reference numerals 136. The algorithm 131 performs line curve fitting as indicated by reference numeral 138 to determine a zero cross intersection as commonly indicated by reference numerals 140 to determine a relative time of arrival as indicated by reference numeral 142 using four points for detection. This information is sent to the interactive electronic table tennis game computer 110 via a universal serial bus (USB) 112 as shown. The above can be called a sensor board 150.

FIG. 5 shows a flowchart from the USB 112 from the sensor board 150 to a delta offset 152 of timing that feeds to a time difference of arrival (TDOA) component 154. Also feeding to the TDOA component 154 are a training program 156 and trained coefficients 158. The TDOA component 154 creates a hit event 160 that is published to games 162, and this goes to a game hit event subscription 164 that allows for object hit detection 166, for example detection of the ball 122.

FIG. 6 shows a flowchart of a generic game overview 200. The first step is initialization indicated by the block designated Init. 202, which then moves to the block named Starting 204. In a kid mode 206 there is a time out designated 208 and then play starts as indicated by box 210. In another mode play starts from the Starting box 204 and moves to the Waiting to Serve box 212, then to the Serving box 214 then to the Playing box 210. In this mode there is no hit time out. During play if no blocks remain on any side, the game ends as indicated by Ended box 216. The players can hit the Quit button 218 or Reset button 220 that resets the interactive electronic table tennis game 10. FIG. 7 shows the compartments 88 or blocks going from an active state to an inactive state.

In one embodiment the LEDs 93 flash on and off when that compartment 88 is hit by the ball 120, and in other embodiments the LEDs 93 remain on after that compartment 88 is hit by the ball 120. In other embodiments all the LEDs 93 are powered and turn off when the compartments 88 are hit by the ball 120. Thus, a new and exciting interactive electronic table tennis game 10 is provided that is enjoyable to play and enjoyable to watch. The interactive electronic table tennis game 10 is suitable for competition play and is suitable for television because the viewing audience will have great fun seeing exactly where the ball 120 hits. In one embodiment the ball 120 is lightweight, hollow, and hard such that it is capable of bouncing off of the hard material 74.

It will be appreciated by those skilled in the art that while the interactive electronic table tennis game 10 has been described in detail herein, the interactive 15 electronic table tennis game 10 is not necessarily so limited and other examples, embodiments, uses, modifications, and departures from the embodiments, examples, uses, and modifications may be made without departing from the interactive electronic table tennis game 10 and all such embodiments are intended to be within the scope and spirit of the appended claims.

What is claimed:

1. A table top for a table tennis game comprising:

a frame base;

a frame mounted on the frame base, wherein the frame is arranged vertically and is perpendicular to the frame base;

a frame top mounted on the frame and wherein the frame top is made of a material that is capable of transmitting light;

at least one compartment within the frame, wherein the compartment is defined by the frame base and at least one pair of a first spaced apart strip of material and a second spaced apart strip of material mounted on the frame base;

at least one light in the at least one compartment;

a power supply:

electronics supported by the frame base;

a computer supported by the frame base;

a first table portion having four audio pickups capable of detecting vibrations and supported by the frame base;

a second table portion having four audio pickups capable of detecting vibrations and supported by the frame base;

the first table portion further comprising at least one frequency filter and a first analog to digital microcontroller supported by the frame base;

the second table portion further comprising at least one frequency filter and a second analog to digital microcontroller supported by the frame base; and wherein the four audio pickups of the first table portion are in communication with the at least one frequency filter of the first table portion which is in communication with the first analog to digital microcontroller and the four audio pickups of the second table portion are in communication with the at least one frequency filter of the second table portion which is in communication with the second analog to digital microcontroller.

2. The table top of claim 1 wherein the at least one light is a light emitting diode.

3. The table top of claim 2 wherein the at audio pickups is a are piezo sensors or a transducers.

4. The table top of claim 3 further comprising a USB in communication with the computer and the first and second analog to digital convertor micro controllers.

5. The table top of claim 4 wherein the first and second analog to digital convertor micro controllers are in communication with the computer and the at least one light emitting diode.

6. The table top of claim 5 wherein the light emitting diode is turned on upon impact of a ball on the frame top.

7. The table top of claim 1 wherein the first analog to digital microcontroller provides four digital filters, four peak detections, four line curve fittings, and four zero cross intersects and wherein the second analog to digital microcontroller provides four digital filters, four peak detections, four line curve fittings, and four zero cross intersects.

8. The table top of claim 7 wherein the first analog to digital microcontroller provides a relative time of arrival and wherein the second analog to digital microcontroller provides a relative time of arrival.

* * * * *